US006376009B1

(12) United States Patent
Bergvall

(10) Patent No.: US 6,376,009 B1
(45) Date of Patent: Apr. 23, 2002

(54) DISPLAY UNIT AND METHOD OF PREPARING SAME

(76) Inventor: Hans Bergvall, Genesmon 1310, S-892 43 Domsjö (SE)

( * ) Notice: Subject to any disclaimer, the term of this patent is extended or adjusted under 35 U.S.C. 154(b) by 0 days.

(21) Appl. No.: 09/431,431

(22) Filed: Nov. 1, 1999

(51) Int. Cl.[7] ..... B05D 5/06; B05D 3/12; B05D 1/36; B24B 1/00; G09F 19/00

(52) U.S. Cl. ..... 427/162; 427/163.4; 427/355; 427/407.1; 427/409; 40/612; 40/615; 451/28; 451/57

(58) Field of Search ..... 427/11, 162, 331, 427/355, 407.1, 409; 40/612, 615, 584; 451/28, 57; 216/88, 89

(56) References Cited

U.S. PATENT DOCUMENTS

| | | | | |
|---|---|---|---|---|
| 3,496,006 A | | 2/1970 | Rideout et al. | |
| 5,073,404 A | * | 12/1991 | Huang | 427/39 |
| 5,227,194 A | | 7/1993 | De La Siera E. | |
| 5,820,978 A | * | 10/1998 | Huang | 428/331 |

FOREIGN PATENT DOCUMENTS

| | | | |
|---|---|---|---|
| DE | 3325 664 A1 | | 1/1985 |
| WO | WO 97/17413 | * | 5/1997 |

* cited by examiner

*Primary Examiner*—Shrive P. Beck
*Assistant Examiner*—Wesley Markham
(74) *Attorney, Agent, or Firm*—Fasth Law Offices; Rolf Fasth

(57) ABSTRACT

A first compound is applied to the polymeric coating of the display unit and the polymeric coating is ground with the first compound to even out a surface of the polymer coating. A second compound is then applied to the polymeric coating and ground on the polymeric coating to form a protective coating on the polymeric coating with the second compound. The protective coating is cleaned and a first polishing compound is applied to an oscillating polishing machine to polish the protective coating with the first polishing compound. A second polishing compound is then applied on the polishing machine and the protective coating is polished with the second polishing compound to form a polishing surface coating on the protective coating so that the retro reflection is at least 11 candela/m$^2$/lux.

9 Claims, 3 Drawing Sheets

FIG. 5 New Traffic Sign in Indoor Environment

Surface Color: Blue

| | Treated Surface | Conventional Surface |
|---|---|---|
| | 12.5 | 9.4 |
| | 12.1 | 9.7 |
| | 12.2 | 9.6 |
| | 11.1 | 9.1 |
| | 11.7 | 9.9 |
| | 12.1 | 10.9 |
| Average | 11.95* | 9.7* |

* Retro reflection measured as candela/$m^2$/lnx with measurement equipment provided by 3M company FIG. 6 Traffic Sign After 3 Years Indoors

| | | |
|---|---|---|
| | 11.6 | 9.3 |
| | 11.8 | 8.9 |
| Average | 11.7* | 9.1* |

* Retro reflection measured as candela/$m^2$/lnx with measurement equipment provided by 3M company FIG. 7 Traffic Sign After 3 Years Outdoors

| | | |
|---|---|---|
| | 10.1 | 9.3 |
| | 10.3 | 8.9 |
| | 10.2 | 8.4 |
| | 10.3 | 8.7 |
| Average | 10.2* | 8.8* |

* Retro reflection measured as candela/$m^2$/lnx with measurement equipment provided by 3M company

DISPLAY UNIT AND METHOD OF PREPARING SAME

TECHNICAL FIELD

The invention relates to a display unit and a method of preparing the surface of display unit such as a traffic sign.

BACKGROUND INFORMATION AND SUMMARY OF THE INVENTION

Conventional traffic signs often have reflective surfaces so that the signs can be clearly seen even though it is dark. More particularly, the reflective surfaces reflect back the light emitted from cars passing the traffic signs. However, the effectiveness of the reflective surfaces can be severely reduced by dirt and wear over time. Conventional reflective traffic signs are often coated with a plastic coating. The plastic coating often cracks over time because the polymer coating dries which further reduces the reflective properties of conventional traffic signs.

To overcome this problem, some municipalities and other maintenance organizations use cleaning crews that drive along the highways and other roads to clean the traffic signs. This is a very slow and labor intensive process. The vehicles used by the cleaning crew themselves may also be a traffic hazard due to the numerous stops made by such vehicles. In many instances, the traffic signs are never cleaned and the reflectiveness of the traffic signs is reduced to unacceptably low levels. This increases the risk of injury to users of the road because they cannot see the signs properly when it is dark outside.

There is a need to improve the effectiveness of the reflective traffic signs and to reduce the need for cleaning the traffic signs. There is also a need to increase the product life cycle of the reflective traffic signs.

The present invention solves some of the above mentioned problems. The method comprises applying a first compound to the polymeric coating and grinding the first compound on the polymeric coating to even out a surface of the polymer coating. A second compound may then applied to the polymeric coating and ground on the polymeric coating to form a protective coating on the polymeric coating with the second compound. The protective coating is cleaned and a first polishing compound is applied to an oscillating polishing machine to polish the protective coating with the first polishing compound. A second polishing compound is then applied on the polishing machine and the protective coating is polished with the second polishing compound to form a polishing surface coating on the protective coating so that the retro reflection is at least 11 candela/$m^2$/lux.

BRIEF DESCRIPTION OF THE DRAWINGS

FIG. 5 is a table showing retro reflection test measurement for a new traffic sign;

FIG. 6 is a table showing retro reflection test measurement after three years in an indoor environment; and FIG. 7 is a table showing retro reflection test measurement after three years in an outdoor environment.

DETAILED DESCRIPTION

Figure 1:
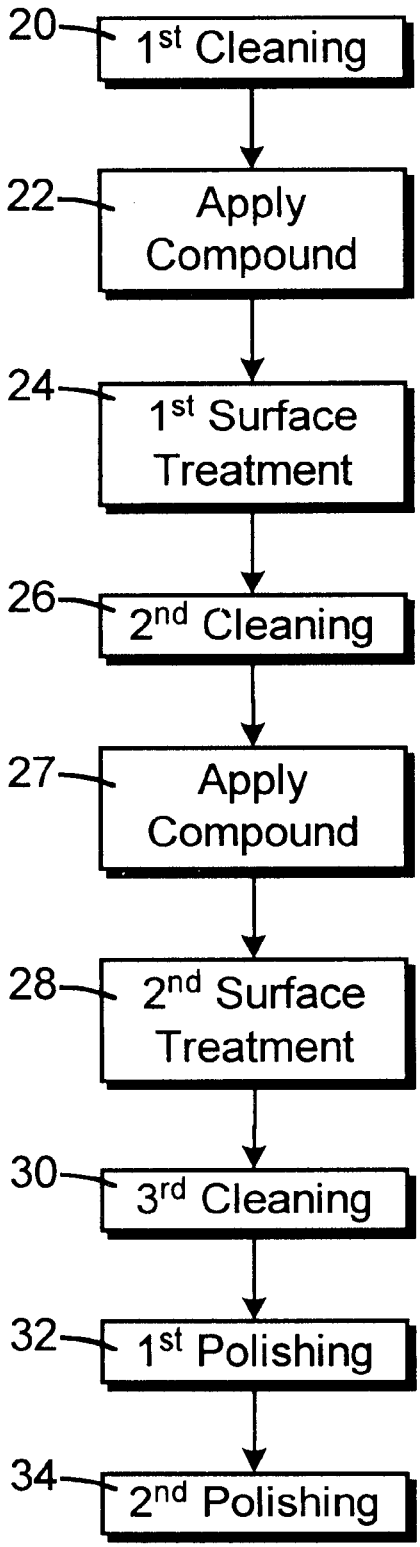
FIG. 1 is a schematic flow diagram showing the steps of the method of the present invention.
Figure 2:
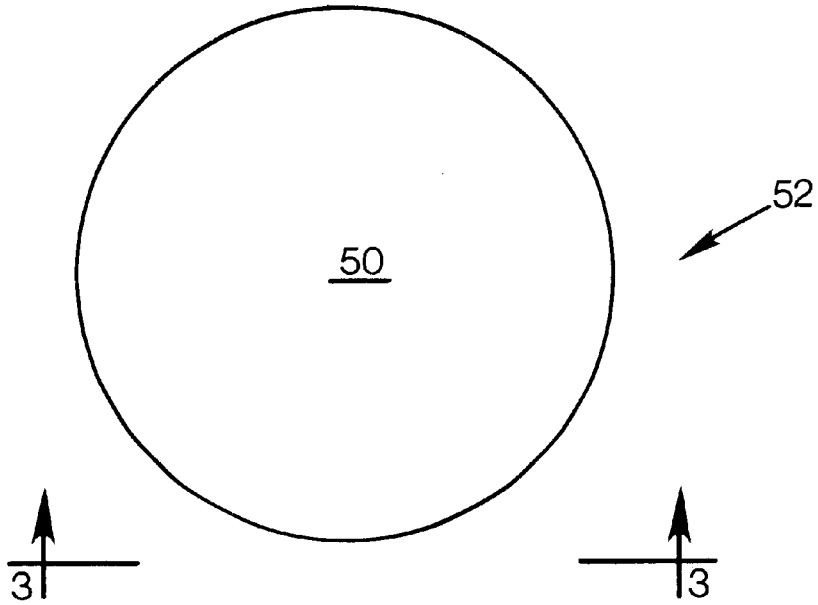
FIG. 2 is a front view of a display unit.
Figure 3:
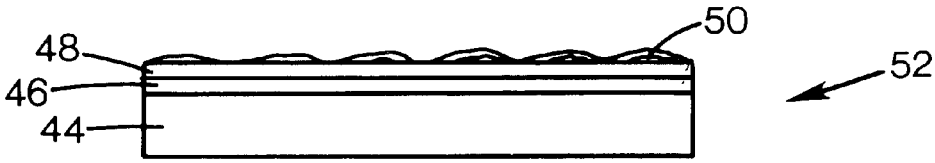
FIG. 3 is a side view along line 3—3 of FIG. 2 of a substantially untreated conventional surface.
Figure 4:
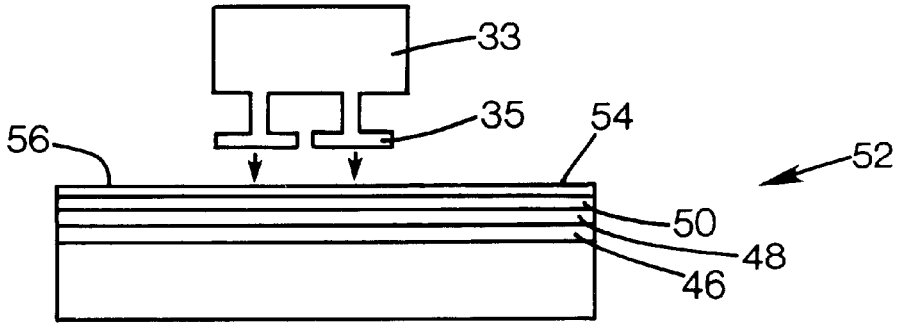
FIG. 4 is a side view along line 3—3 of FIG. 2 of a treated surface.

With reference to FIGS. 1–4, the present invention comprises a method for making uneven surfaces of display units, such as traffic signs, very smooth to improve the reflective properties of the traffic signs while reducing the maintenance requirements of the traffic signs because dirt does not adhere as easily and the surfaces of the traffic signs do not crack. A typical traffic sign 52 has a metal sheet 44 (best shown in FIG. 3) that is coated with a reflective material 46 that in turn is coated with a polymeric protective coating 48 that has a relative wavy and uneven outer surface 50.

In the preferred method of the present invention, the first step 20 is to clean the surface 50 of the traffic sign 52 with, for example, water together with a soap to soften the water. The cleaning step 20 removes dirt, dust and other articles to prevent later treatment steps from scratching the surface 50. A suitable degreaser to remove grease may also be used, Any undesirable grease is, preferably, removed from the surface 50 to prevent the foam used in later steps from absorbing the grease. For example, MICROL, which is an environmentally safe micro-emulsifying degreaser, may be used. Other suitable degreaser agents may also be used.

When the surface 50 has been cleaned, according to step 20, a first compound may be applied to the surface in step 22. The first compound may both be used to remove oxidations on the surface 50 and to even out any irregularities in the surface 50 because the first compound also includes abrasives. The abrasiveness of the first compound must be such that the protective coating 48 (see FIG. 3) is not removed to expose the reflective material 46. It is also important that the friction heat generated during the compounding step 22 is not too high to damage the protective coating 48. As mentioned above, an important function of the first compound is to remove the waviness of the surface 50. The first compound also removes any remaining dirt on the surface 50 and in the pores of the surface 50. A suitable first compound is a water-soluble compound called RB 103 made by AS Err-Bee. This rubbing compound includes abrasives, n-paraffins, n-normals, decanes, odecanes, tridecanes and desolvents but not silicon. The first surface treatment 24 after the first compound has been applied in step 22 is very important. The realization that the surfaces of conventional traffic signs is not sufficiently smooth is significant. In the preferred method, a grinding machine may be used to remove any excessive abrasive first compound applied in step 22 on the surface 50 to further even out the surface 50. More particularly, the grinding machine should have a very soft rotating application surface that is made of, for example, a foam-rubber or lamb wool mat. The foam-rubber mat is suitable because it evenly distributes the pressure on the surface 50. The foam-rubber mat should rotate at about 1,400–1,850 rpm. A rotational speed of up to 3,000 rpm could be used if plenty of cooling water is used to prevent the polymer coating 48 and the surface 50 from becoming too hot. In other words, the rotation speed should be such that the polymer coating 48 and the surface 50 are not damaged or removed. Water may be added in a spraying step to both uniformly cool the polymer coating 48 and to evenly distribute the abrasive first compound that was applied in step 22. The water also reduces the risk for the rotating foam-rubber mat damaging the polymer coating 48 and the delicate surface 50. The treatment step 24 should last about 30 seconds or until the surface 50 is exceptionally smooth. The maximum operation temperature should not exceed 70° C. because the first compound may include a desolvent that loses its effect at very high temperatures and may even catch fire.

In the cleaning step 26, the traffic sign 52 may be cleaned with, preferably, water, a degreaser and cleaning agent, such as MICROL, that may be sprayed on the surface 50 to reduce the surface tension of the water and to further remove any excess first compound from the previous surface treatment 24.

The second surface treatment 28 is substantially identical to the first surface treatment 24. A second compound is applied in a step 27 to the surface 50 in a way that is similar to the application of the compound in step 22. The second treatment 28 is preferably identical to the first compound applied in step 22 and should last for about 30 seconds. It is again important not to treat the surface 50 too long so that the polymer coating 48 is damaged or even removed. One significant function of the second compound in the second treatment 28 is to permit the compound applied in step 22 to form a sealing outer protective coating 54. The coating 54 prolongs the life of the polymer coating 48.

In the cleaning step 30, any loose and excessive second compound may be mechanically removed. For example, the surface 50 may then be dried with a rug. No cleaning or degreasing agent should be applied in this step so as not to damage the delicate coating 54 and to prepare the coating surface 54 for the first polishing step 32.

In the first polishing step 32, a polishing compound may be applied to an oscillating polishing machine 33 that may have one relatively large or two smaller application surfaces 35. Two smaller application surfaces are preferred because there is less difference in temperature between the periphery and the center of the rotating discs. A back and forth movement of the rotation discs is preferred to further reduce the friction heat. More particularly, during the rotation, very large rotational discs tend to generate a higher temperature at the periphery of the disc and a lower temperature is generated at the center of the rotational disc. This uneven temperature distribution may damage the coating 54. A back and forth movement of relatively small discs is therefore preferred.

The first polishing compound used in the polishing step 32 is finer than the first rubbing compound used in step 22 and contains finer or less abrasive material. For example, a super-gloss or ultra gloss polishing compound may be used. Ultra Tech Manufacturing Inc. makes a suitable polishing compound that includes siloxane and a small amount of TEFLON. Preferably, the first polishing compound is applied directly onto the application surfaces of the polishing machine to reduce waste and spillage. In the preferred method of the present invention, the pressure applied to the coating 54 should be between 1–3 grams/cm$^2$. This pressure is also suitable in steps 24, 28. If the pressure is higher there is a risk for too high a temperature that may damage the coating 54. In the first polishing step 32, the first polishing compound both cleans and polishes the coating 54. The first polishing step 32 lasts for about one minute. The polished coating 54 is then carefully cleaned.

In a second polishing step 34, a second polishing compound is again applied to the polishing machine and the coating 54 is polished. The second polishing compound is preferably identical to the first polishing compound. During the step 34, the second polishing compound not only cleans and polishes but also leaves a very smooth and hard thin coating surface 56. The second polishing step 34 also lasts for about one minute. Of course, the step 34 may lasts longer or shorter depending upon the condition of the coating 54 and the coating surface 56 and the speed and pressure of the polishing machine.

The coating surface 56 provides outstanding retro reflection properties. FIGS. 5–7 show test results comparing the properties of traffic signs that have been prepared or treated according to the method of the present invention with untreated conventional traffic signs. More particularly, FIG. 5 shows an average retro reflection of 11.95 candela/m$^2$/lux for new traffic signs that have been treated compared to 9.7 candela/m$^2$/lux for the conventional traffic signs. This is an increase of the retro reflection properties of 24 percent. The retro reflection properties were measured with measurement equipment provided by the 3M Company.

FIG. 6 shows test values for traffic signs that have been indoors for 3 years. The average retro reflection of the traffic signs that have been treated according to the present invention was 11.7 candela/m$^2$/lux compared to 8.8 candela/m$^2$/lux for conventional traffic signs that also have been stored indoors for 3 years. This represents an increase in the retro reflection of about 29 percent.

Similarly, FIG. 7 shows the retro reflection values for traffic signs that have been outdoors for 3 years. The retro reflective properties for the treated traffic signs were 10.2 candela/m$^2$/lux compared to 8.8 candela/m$^2$/lux for the conventional traffic signs. This represents an increase of about 16 percent.

While the present invention has been described in accordance with preferred compositions and embodiments, it is to be understood that certain substitutions and alterations may be made thereto without departing from the spirit and scope of the following claims.

We claim:

1. A method of treating a reflective display unit having a reflective layer covered by a polymeric coating, comprising:

a) applying a first compound to the polymeric coating;

b) grinding the first compound on the polymeric coating and evening out a surface of the polymer coating;

c) applying a second compound to the polymeric coating, d) grinding the second compound on the polymeric coating to form a protective coating of the second compound on the polymeric coating;

e) cleaning the protective coating;

f) applying a first polishing compound on a polishing machine;

g) polishing the protective coating with the first polishing compound on the polishing machine;

h) applying a second polishing compound on the polishing machine;

i) polishing the protective coating with the second polishing compound to form a polishing surface coating on the protective coating.

2. The method according to claim 1 wherein the method further comprises applying a degreaser to the polymeric coating prior to step a.

3. The method according to claim 1 wherein step b further comprises removing oxidations on the polymeric surface.

4. The method according to claim 1 wherein step a comprises applying a rubbing compound containing abrasives and paraffins.

5. The method according to claim 1 wherein step b is performed with a grinding machine having a rotatable foam-rubber mat that rotates between about 1400 and 1850 rpm.

6. The method according to claim 1 wherein step g is performed with an oscillating polishing machine.

7. The method according to claim 6 wherein step g comprises a back and forth movement of the oscillating polishing machine to reduce generation of heat.

8. The method according to claim 1 wherein step g comprises applying a polishing pressure between about 1 gram/cm$^2$ and 3 gram/cm$^2$.

9. The method according to claim 1 wherein step i is continued until the display unit has a retro reflectiveness of at least 11 candela/m$^2$/lux.

* * * * *